United States Patent [19]

Kawaguchi et al.

[11] Patent Number: 4,570,272

[45] Date of Patent: Feb. 18, 1986

[54] TOILET BOWL FLUSHING DEVICE

[75] Inventors: Shojiro Kawaguchi; Kuniyuki Odaka, both of Kadoma, Japan

[73] Assignee: Matsushita Electric Works, Ltd., Osaka, Japan

[21] Appl. No.: 636,406

[22] Filed: Jul. 31, 1984

[30] Foreign Application Priority Data

Aug. 11, 1983 [JP] Japan ..... 58-147087

[51] Int. Cl.[4] ..... E03D 13/00

[52] U.S. Cl. ..... 4/302; 4/305; 4/DIG. 3

[58] Field of Search ..... 4/304, 305, 300, DIG. 3, 4/406, 302, 303

[56] References Cited

U.S. PATENT DOCUMENTS

| | | | |
|---|---|---|---|
| 3,434,164 | 3/1969 | Forbes | 4/304 |
| 3,908,204 | 9/1975 | Hopkins | 4/DIG. 3 |
| 4,134,163 | 1/1979 | Matsunaga | 4/304 |
| 4,342,443 | 8/1982 | Wakeman | 251/137 |
| 4,471,498 | 9/1984 | Robertshaw | 4/305 |

FOREIGN PATENT DOCUMENTS 29601 3/1981 Japan .

*Primary Examiner*—Stephen Marcus
*Assistant Examiner*—Leo James Peters
*Attorney, Agent, or Firm*—Burns, Doane, Swecker & Mathis

[57] ABSTRACT

A toilet bowl flushing device capable of discharging automatically a large amount of flushing water to the bowl immediately after termination of use of the bowl and a small amount of water continuously from the beginning of the use until a predetermined time has elapsed after the large amount discharge. Valve means for controlling the amount of water provided to the bowl includes a small-amount water discharging means and a large-amount water discharging means, and is coupled to a control means including a timer means suitably energizing the small-amount and large-amount water discharging means so that an auxiliary bowl flushing is performed with a small amount of flushing water to prevent sticking of filth to the bowl during the use, a main bowl flushing is realized with a large amount of flushing water immediately after the use, and a small amount of flushing water is kept discharged still after the main flushing to avoid any generation of water hammering phenomenon.

3 Claims, 13 Drawing Figures

TOILET BOWL FLUSHING DEVICE

TECHNICAL BACKGROUND OF THE INVENTION

This invention relates to a toilet bowl flushing device which discharges flushing water only when a person uses the bowl.

Known bowl flushing devices of the kind referred to are arranged so that a certain amount of flushing water will be discharged to the toilet bowl at every use thereof by, for example, manually depressing a push button in a valve means of the device, because a permanent discharge of flushing water requires a great deal of water, which is disadvantageous from economical and water resource view points.

DISCLOSURE OF PRIOR ART

Various types of the toilet bowl flushing devices have been so far suggested and, among these devices, the one requiring the manual operation of the valve means at every use has been such problems that, the bowl will not be flushed when the user forgets to push the button, and that repetitive use of the bowl without being flushed will cause filth to stick to the surface of the bowl to be unhygienic. In order to remove the problems, there has been suggested in Japanese Patent Publication No. 29061/1981 a device wherein means for detecting the use of the bowl is provided so that an auxiliary valve will be automatically opened in response to an output from the detecting means for discharging a small amount of flushing water from the beginning to the end of the use so as to prevent the filth from sticking to the bowl surface during the use, while a main valve is opened upon detection of termination of the use for discharging a large amount of flushing water to fully clean the bowl. However, this known arrangement has been still defective in that, since the main valve opened to discharge the large amount of flushing water after termination of the use has to be momentarily closed to abruptly stop the water, a so-called water hammering phenomenon takes place in a drain pipe means of the device, generating a remarkable shock sound, and the valve means, pipe coupling means or the like is thereby caused to be damaged.

OBJECT OF THE INVENTION

A primary object of the present invention is, therefore, to provide an automatically operable toilet bowl flushing device which can effectively realize auxiliary and main flushings of toilet bowl to be able to maintain the bowl always in clean state, without causing any water hammering phenomenon even when a sufficient main flushing is performed with a large amount of water, and which is thus remarkably improved in the durability.

This object of the present invention can be achieved by arranging the device for having a small-amount water discharging means started to be actuated upon initiation of the use of associated toilet bowl by a person and also a large-amount water discharging means actuated upon termination of the use, and then continuously operating the small-amount water discharging means kept actuated for a predetermined time after deenergization of the large-amount water discharging means. With this arrangement, a small amount water flushing is kept performed even after stopping of a large amount water flushing so that any water hammering phenomenon can be prevented from occurring.

Other objects and advantages of the present invention shall become clear from the following description of the invention detailed with reference to embodiments illustrated in accompanying drawings.

Figure 1:
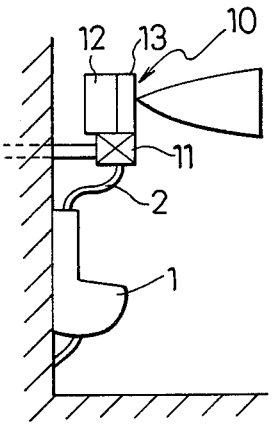
FIG. 1 is a schematic view of a toilet bowl flushing device according to the present invention.

While the present invention shall now be described with reference to preferred embodiments shown in the drawings, it should be understood that the intention is not to limit the invention only to the particular embodiments shown but rather to include all alterations, modifications and equivalent arrangements possible within the scope of appended claims.

DISCLOSURE OF PREFERRED EMBODIMENTS

Referring first to FIG. 1, a toilet bowl 1 is connected through a water supply pipe 2 to a toilet bowl flushing device 10, which includes a valve means 11 comprising preferably an electromagnetic valve for adjusting the rate of flushing water sent to the bowl 1. This valve means 11 comprises means for discharging a small amount of flushing water and means for discharging a large amount of flushing water, and is properly operated by a control means 12 which is interlocked with such a human body sensor 13 as an ultrasonic-wave sensor for detecting that the bowl 1 is in use and continuously generating an ON signal. A timer means is provided in the control means 12 so as to properly set opening time of the small and large amount water discharging means in the control means. In this case, the control means 12 is arranged so as to energize the small amount water discharging means so that the bowl 1 will be wetted before being used, and to energize the large amount water discharging means when the human body sensor 13 provides an OFF signal responsive to that the user leaves the bowl, but to have the small amount water discharging means deenergized as delayed from a deenergization of the large amount water discharging means. For the human body sensor 13, a reflectional ultrasonic-wave sensor can be most effectively used, while a penetrating type ultrasonic-wave sensor, breakactuation type photoelectric switch and the like may also be used.

Figure 2:
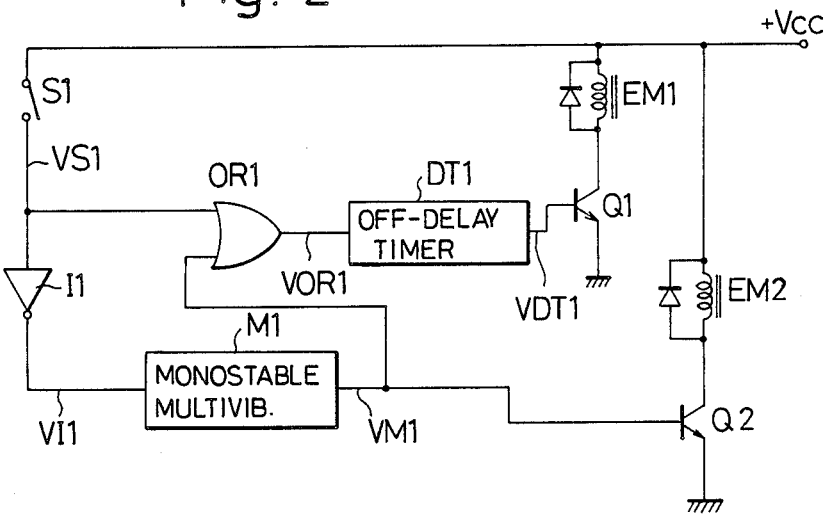
FIG. 2 is a circuit diagram of an embodiment of a control means employed in the present invention.
Figure 3:
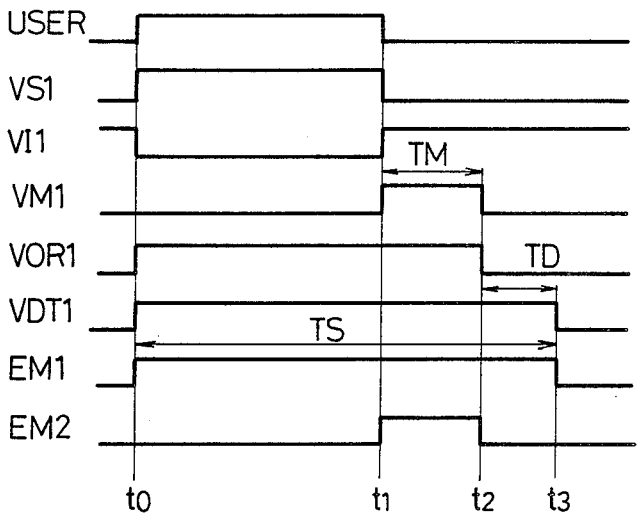
FIG. 3 is a timing chart showing the operation of the circuit shown in FIG. 2.

Referring further to FIG. 2, there is shown a circuit diagram in a practical aspect of the control means, which shall be detailed also by references to a time chart shown in FIG. 3 of the operation of the circuit. Now, the time when a user stands in front of the bowl 1 is made "t0" and the time when he leaves the bowl 1 is made "t1", and an output switch S1 of the human body sensor 13 is turned ON at "t0" and OFF at "t1". An output signal VS1 indicative of these ON and OFF states is provided to an inverter circuit I1 which generates an output VI1 and triggers a monostable multivibrator M1 upon rising of the output VI1 at "t1", and an output VM1 of the multivibrator M1 is made to be at H level up to a time "t2". The output signal VS1 of the sensor 13 and the output VM1 of the multivibrator M1 are provided to two input terminals of an OR circuit OR1, and an output VOR1 is provided from the OR circuit OR1 to an OFF-delay timer DT1 which functions to generate an H level output VDT1 at the same time when an H level input is received and to maintain this H level output for a predetermined time period even after a shift of the input to an L level. This causes a transistor Q1 to be turned ON and an electromagnetic coil EM1 to be excited during a period from "t0" to a time "t3", whereas the output VM1 of the monostable multivibrator M1 causes a transistor Q2 to be turned ON and an electromagnetic coil EM2 to be excited during a period from "t1" to "t2". Therefore, when the electromagnetic coils EM1 and EM2 are employed as applied respectively to each of the small and large amount water discharging means, a small amount of flushing water can be continuously discharged during a term TS and a large amount of flushing water can be discharged during a term TM as shown in FIG. 4, in which only the discharge of the small amount of water is kept continued during a term TD following the large amount discharging term TM and the water hammering phenomenon can well be prevented.

Figure 5:
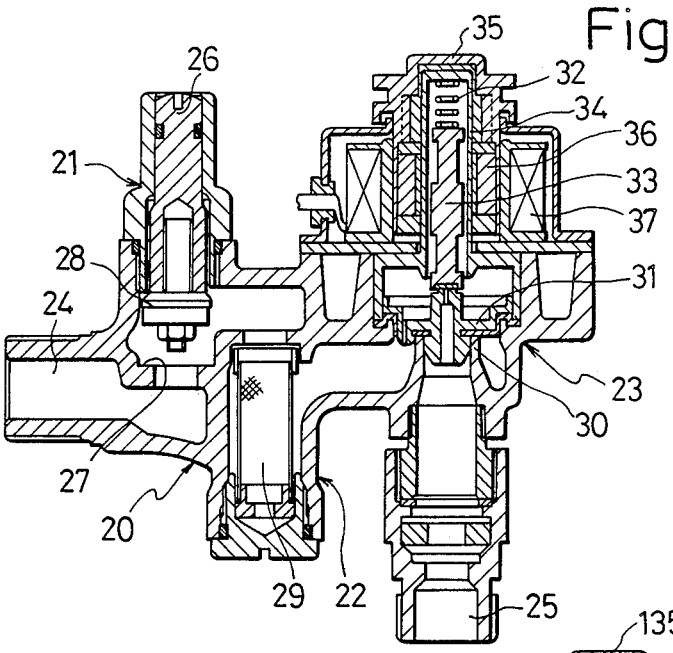
FIGS. 5 and 6 are sectional views showing different embodiments of valve means employed in the present invention.

Referring to FIG. 5, there is shown an embodiment of the valve means which includes the small and large amount water discharging means. The valve means further comprises a pair of valve members (only one of which is illustrated). In one valve member 20, a water stop cock section 21 for manually stopping water flow, a filter section 22 for eliminating such foreign matter as dust from the flushing water and an electromagnetic valve section 23 capable of discharging the washing water as required are sequentially arranged in downstream direction between an inlet 24 and an outlet 25. In the present instance, the water stop cock section 21 is arranged to be able to stop the water flow when a water stop plug 26 screwed into a valve body casing is rotated until a valve 28 sits on a valve seat 27. The filter section 22 is arranged so that a cylindrical filter 29 filtrates such foreign matter as dust. On the other hand, the electromagnetic valve section 23 includes a main valve 31 separably seated on a valve seat 30, the main valve 31 is connected to a valve plunger 33 acting to have the main valve 31 seated on the valve seat 30 under influence of a depressing spring 32, the valve plunger 33 in turn is housed in a cylinder 34. Around the cylinder 34, there are disposed a permanent magnet 36 coupled to a manually elevatable knob 35, and an electromagnetic coil 37 provided around the permanent magnet 36 so that, when the electromagnetic coil 37 is excited, the valve plunger 33 normally biased into closing position by the depressing spring 32 will be electromagnetically attracted to move upward, whereby the main valve 31 is separated from the valve seat 30 and the water flow path is opened.

Figure 4:
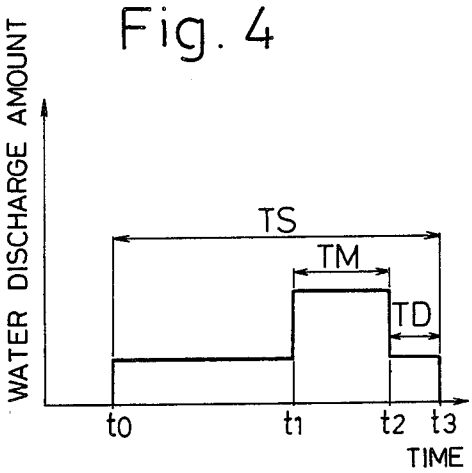
FIG. 4 is a timing chart showing the water discharging state of the control means of FIG. 2.

Accordingly, when a pair of the valve members respectively having different areas of an orifice defined between the main valve 31 and the valve seat 30 as they separate from each other are provided as the valve means 11 to the toilet bowl 1 and the respective electromagnetic coils 37 of the both valve members are employed as the electromagnetic coils EM1 and EM2 in the control means of FIG. 2, such small and large amount water flushings as in FIG. 4 can be achieved during the respective predetermined terms. While the references have been made in respect to a pair of the valve members, the same operation can be also obtained even when the water stop cock and filter sections are employed commonly to one valve member but a pair of electromagnetic valve sections of the different orifice areas are provided respectively in each of two divided paths at downstream position of the filter section. Further, the provision of the manually elevatable knob 35 makes it possible to have the valve plunger 33 manually lifted to open the main valve 31, even when the electromagnetic coil is not energizable due to commercial power source interruption.

Figure 6:
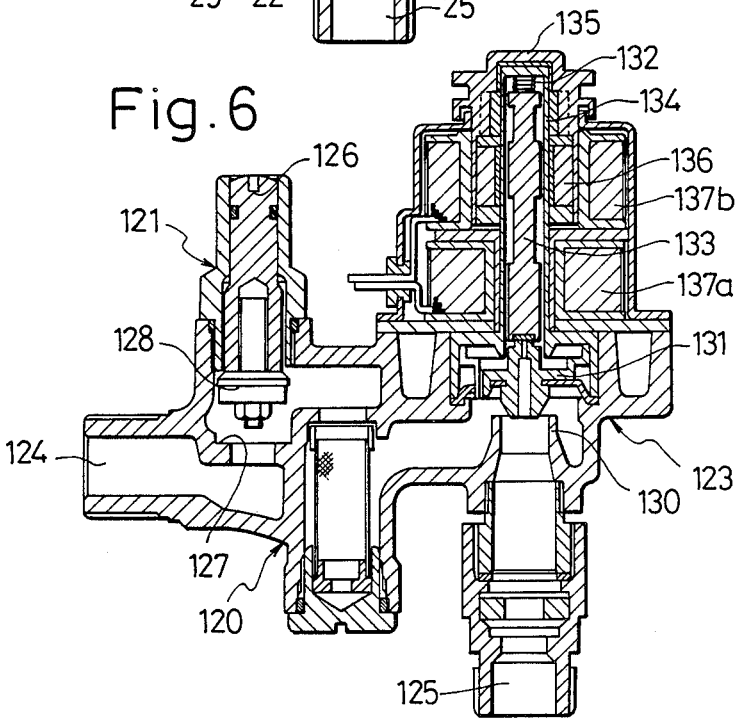

FIG. 6 shows another embodiment of the valve members in the valve means, in which members similar to those in FIG. 5 are denoted by the same numbers but as added with 100. In particular, a valve member 120 is not used in the pair but a single electromagnetic valve section 123 is adapted to perform the discharges of the both small and large amount flushings. That is, a valve plunger 133 is made longer than the plunger 33 in FIG. 5 and electromagnetic coils 137*a* and 137*b* surrounding the valve plunger 133 are disposed in upper and lower positional relation to each other, so as to act respectively in correspondence to the electromagnetic coils EM1 and EM2 in FIG. 2. Thus, when the lower electromagnetic coil 137 is excited, the main valve 131 is separated from the valve seat 130 but the tip end of the main valve will still remain inside the valve seat so that the orifice area defined between them will be small and the small amount water discharge will be effected. A further excitement of the upper electromagnetic coil 137*b* causes the depressing spring 132 to be compressed to its maximum extent and the valve plunger 133 to be moved up to such a position as illustrated, the distance between the main valve 131 and the valve seat 130 becomes maximum, and the orifice area between them is thereby made sufficiently large enough for achieving the large amount water discharge. Similarly to the case of FIG. 5, therefore, the operational function as in the case of FIG. 4 can be equally achieved.

Figure 7:
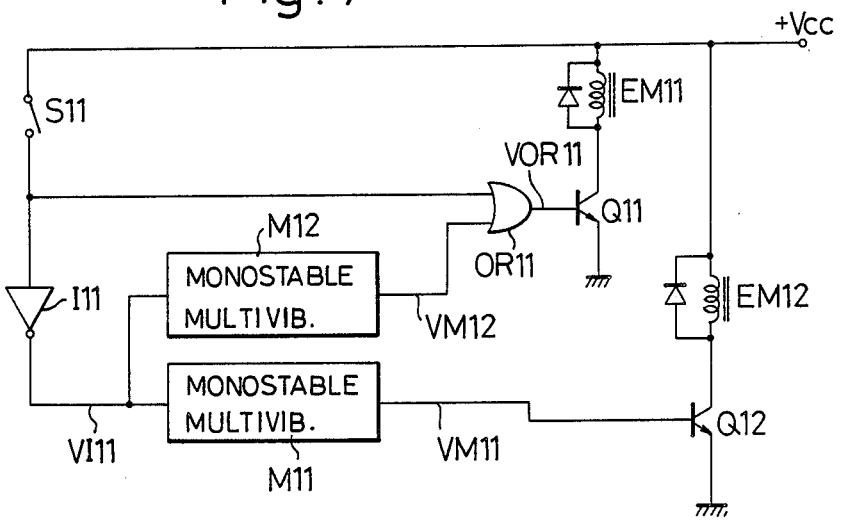
FIGS. 7 and 8 are circuit diagrams showing other embodiments of the control means of the present invention.

FIG. 7 shows a circuit diagram of another embodiment of the control means, of which circuit elements similar to those in FIG. 2 are shown by the same reference symbols but with their accompanying numerals added by 10. In the illustrated control means, specifically, a second monostable multivibrator M12 is connected in parallel to the first monostable multivibrator M11 which provides an output VM11 through the transistor Q12 to the electromagnetic coil EM12 corresponding to the large-amount water discharging means. Further, an output pulse VM12 of the second monostable multivibrator M12 is set to have a larger pulse width than the output pulse VM11 of the first monostable multivibrator M11, so that the output of the OR circuit OR11 which receives the output from the output contact S11 of the human body sensor and the output VM12 from the second multivibrator M12 can be made substantially to be the same as the output signal "VDT1" in FIG. 3, whereby the OFF signal to the electromagnetic coil EM11 can be delayed with respect to the OFF signal to the electromagnetic coil EM12 without requiring any OFF delay timer and the same operational function as in FIG. 4 can be effected.

Figure 8:
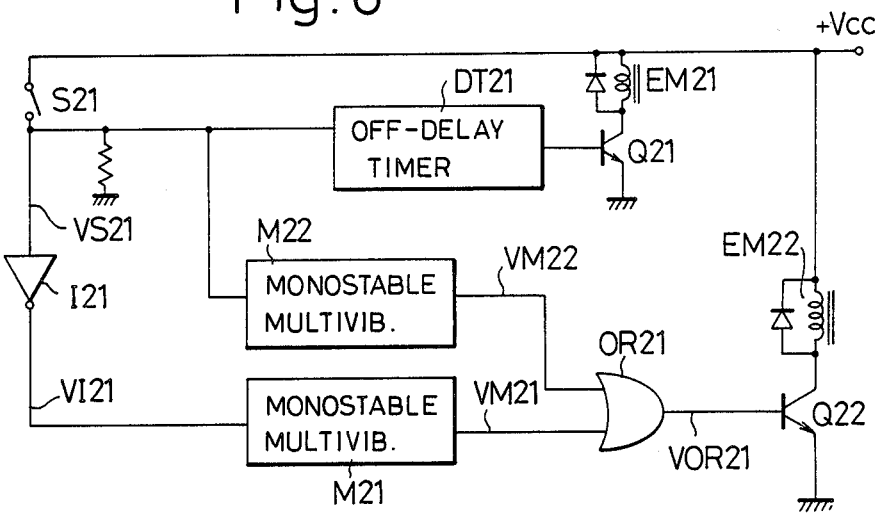

FIG. 8 shows a circuit diagram of still another embodiment of the control means, of which circuit elements substantially the same as those in FIG. 7 are denoted by the same reference symbols but with their accompanying numerals added by further 10. In this control means, as will be made clear by references to FIG. 9, the electromagnetic coil EM21 corresponding to the small-amount water discharging means is energized through the transistor Q21 by an output signal VDT21 of an OFF delay timer DT21 which receives directly the output signal from the output contact S21 of the human body sensor. On the other hand, the electromagnetic coil EM22 corresponding to the large-amount water discharging means is energized through the transistor Q22 by the output VOR21 of the OR circuit OR21 which receives the output VM22 of the monostable multivibrator M22 together with the output VM21 of the monostable multivibrator M21 having the same function as that M1 or M11 in FIG. 2 or 7, the output VM22 being at H level for a relatively short term TMS from "t0" of the initiation of the use of the bowl, in response to the signal VS21 from the output switch S21. Accordingly, the output VOR21 of the OR circuit OR21 is also at H level during the term TMS, in addition to such normal large amount flushing term TM as shown in FIG. 3 or 4, and thus a large amount discharge of water can be performed immediately after the initiation of bowl use, so that the entire bowl can be reliably wetted immediately after the initiation of use so as to promote the auxiliary flushing effect.

Figure 10:
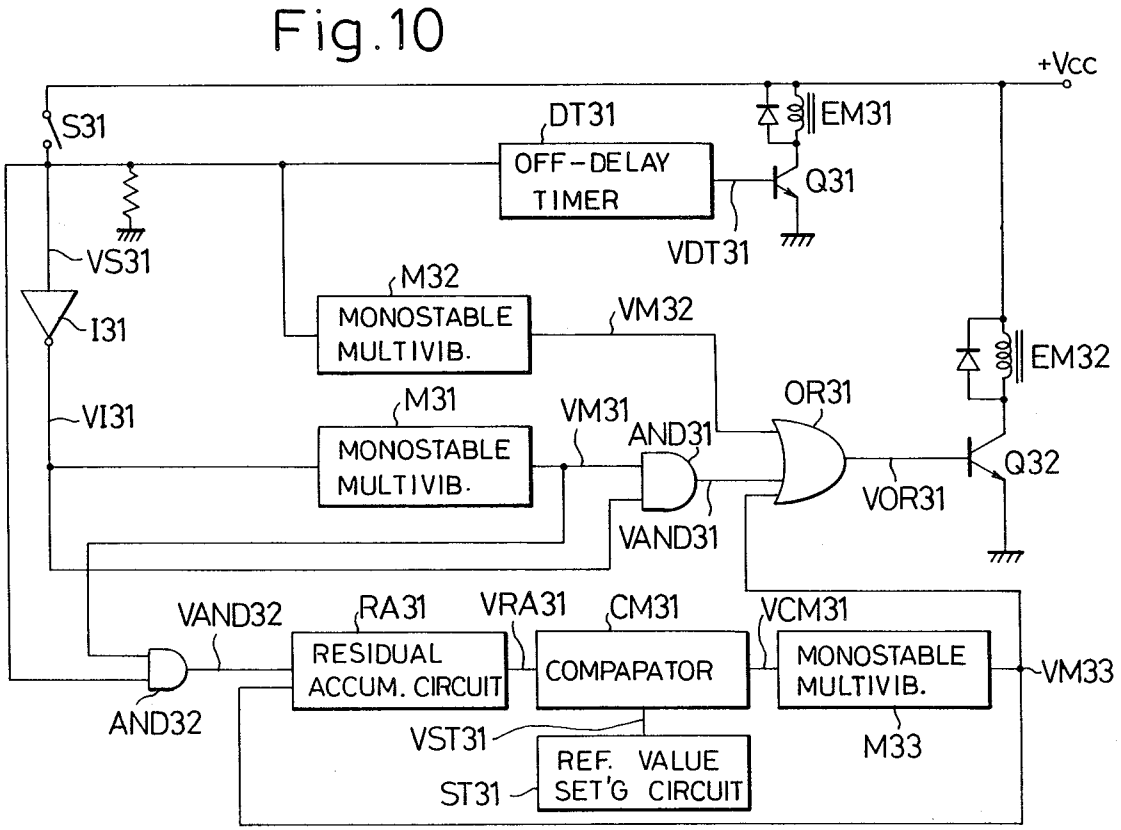
FIG. 10 is a circuit diagram of still another embodiment of the control means of the present invention.

FIG. 10 shows a circuit diagram of a still further embodiment of the control means, of which circuit elements substantially the same as those in FIG. 8 are denoted by the same reference symbols with their accompanying numerals added further by 10. This control means is adapted, in contrast to the case of FIG. 8, to the case where a plurality of persons are to use the bowl in sequential manner. Explanation shall be made in detail also with reference to FIG. 11. As in the case of FIG. 8, the electromagnetic coil EM31 corresponding to the small-amount water discharging means is energized by the output signal VDT31 of the OFF delay timer DT31, and the electromagnetic coil EM32 corresponding to the large-amount water discharging means is energized by the output VOR31 of the OR circuit OR31. In this case, the OR circuit OR31 receives the output VM32 of monostable multivibrator M32 having substantially the same function as that M22 in FIG. 8 and an output VAND31 of an AND circuit AND31, to which there are provided an output VM31 of a further provided monostable multivibrator M31 having substantially the same function as that M21 in FIG. 8 and directly the output VI31 of the inverter circuit I31, and generates its logical product.

Figure 9:
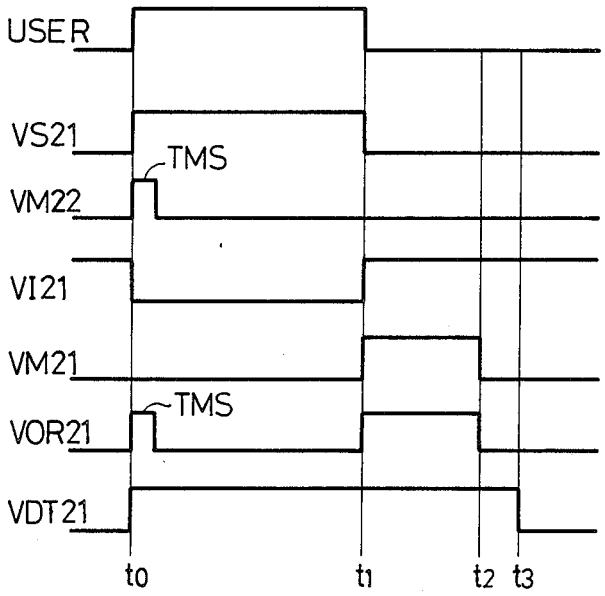
FIG. 9 is a timing chart showing the operation of the circuit of FIG. 8.
Figure 11:
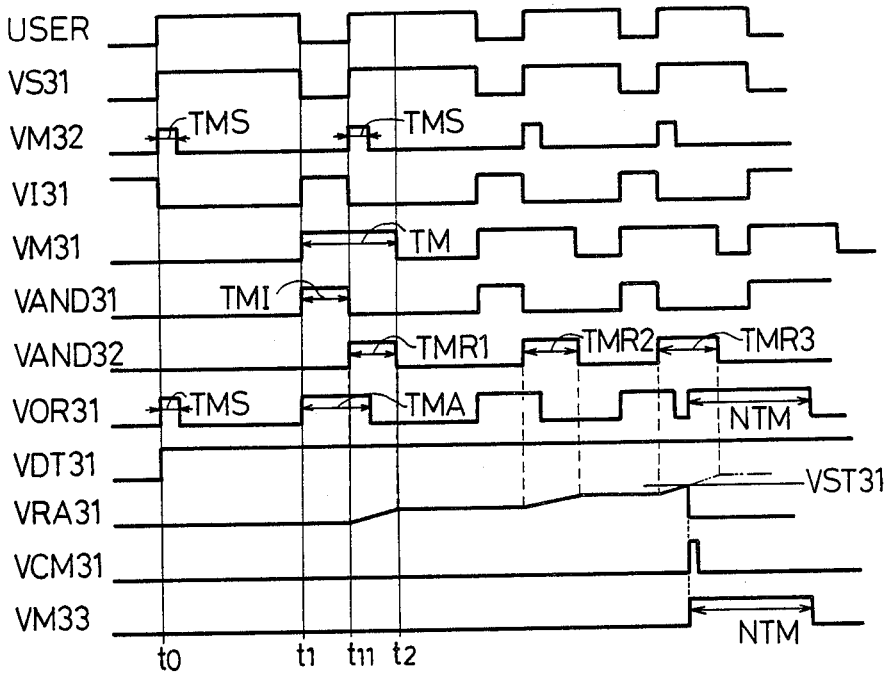
FIG. 11 is a timing chart showing the operation of the circuit of FIG. 10.

When a next user comes in front of the bowl specifically immediately after the termination of the large amount water discharge, the operation shown in FIG. 9 is carried out substantially in the same manner as in the embodiment of FIG. 8, since the AND circuit AND 31 provides the same output as the monostable multivibrator M31. When, on the other hand, the next user comes to the bowl during the large amount water discharge, the AND circuit AND31 receives the voltage signals VM31 and VI31, the output VAND31 of the AND circuit AND31 is not to be at H level during the term from "t1" to "t2" corresponding to the normal large amount water discharge term TM but rather to be at L level upon falling of the signal VI31 at "t11" as seen in FIG. 11. In other words, the output VAND31 is at H level only during a relatively short term TMI. On the other hand, the OR circuit OR31 receives the output VAND31 of the AND circuit AND31 and the output VM32 of the monostable multivibrator M32, and the output VM32 becomes H level during a very short term TMS starting from "T11" at which the next user comes to the bowl. Accordingly, the output VOR31 of the OR circuit OR31 becomes H level only during a term which is the sum of the terms TMI and TMS. As a result, the large amount water discharge performed initially for the next user is only for the term TMS provided to the previous user, and it can be effectively prevented that such an excessively larger amount of water that likely to cause a splash or overflow is caused to occur.

In the control means of FIG. 10, there is further provided such an arrangement that prevents any insufficient flushing from occurring due to the shortened term of the large amount water discharge as above upon initiation of use by the next user. That is, another AND circuit AND32 receives the output signal VS31 from the output switch S31 of the human body sensor and the output signal VM31 of the monostable multivibrator M31, and generates a signal of H level during a term from "t11" to "t2" from which the large amount water discharge is omitted. In the case where, for example, a plurality of persons sequentially repetitively use the bowl, the AND circuit AND32 generates such a signal of H level as shown by an output signal VAND32 in FIG. 11 during respective terms TMR1, TMR2, TMR3, . . . , and TMRn. These terms are accumulated at a residual accumulating circuit RA31, and an output VRA31 is provided to a comparator CM31, from which a triggering output VCM31 is provided to a monostable multivibrator M33 as seen in FIG. 11 when the output VRA31 exceeds a reference value VST31 supplied from a reference value setting circuit ST31 to the comparator CM31. Upon receipt of this signal VCM31, the multivibrator M33 is triggered to provide an output VM33 to the OR circuit OR31 to energize the electromagnetic coil EM32 of the large amount discharging means through the transistor Q32, so that a large amount of water discharge can be realized during a term NTM set by the multivibrator M33 and the insufficient flushing can be prevented. The output VM33 of the monostable multivibrator M33 is also provided to the residual accumulating circuit RA31 to clear the accumulated value in the circuit RA31 simultaneously with the large amount water discharge.

Figure 12:
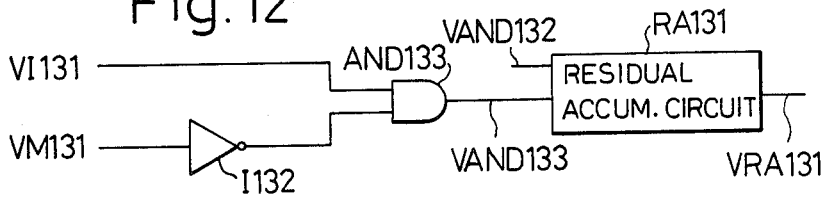
FIGS. 12 and 13 are diagrams showing different embodiments of an accumulated-value clearing circuit employed in the present invention.
Figure 13:
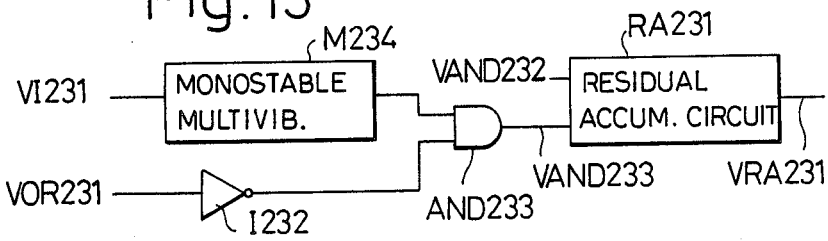

For clearing the accumulated value, various arrangements may be employed. As will be obvious from the time chart of FIG. 11, the accumulated value can be cleared as shown, for example, in FIG. 12, by applying to the two input terminals of an AND circuit AND133 an output signal VI131 corresponding to the output VI31 of the inverter circuit in FIG. 10 and an output of an inverter circuit I132 receiving an output VM131 corresponding to the output VM31 of the monostable multivibrator M31 in FIG. 10, and then by applying an output VAND133 of AND circuit AND133 in addition to an signal VAND132 corresponding to the output VAND32 of the AND circuit AND32 in FIG. 10 to the residual accumulating circuit RA131. Or, as shown in FIG. 13, an output signal VOR231 corresponding to the output VOR31 in FIGS. 10 and 11 is provided to an inverter circuit I232, an output VI231 corresponding to the output VI131 is provided to a monostable multivibrator M234 to trigger the same, outputs of the inverter I232 and multivibrator M234 are provided to an AND circuit AND233, and an output VAND233 of the AND circuit AND233 is provided to the accumulating circuit RA231, so that the output VAND233 can clear the accumulated value in the circuit RA231 when the large amount water discharge is made beyond a predetermined term.

We claim:

1. A toilet bowl flushing system, comprising:

(a) an electromagnetic valve means including means for discharging a low flow-rate of flushing water to said bowl and means for discharging a high flow-rate of flushing water to the bowl;

(b) means for detecting approach and departure of users of said bowl, said detecting means generating an ON signal indicative of said approach and initiation of use of said bowl by a first user, a first OFF signal indicative of said departure and termination of use of said bowl by said first user, a second OFF signal indicative of approach of a second user immediately after departure of said first user, and a third OFF signal indicative of departure of said second user; and (c) means for controlling operation of said valve means, including (1) first means responsive to said ON signal from said detecting means for energizing said high flow-rate water discharging means for a relatively short first period of time upon said initiation of use by said first user;

(2) second means for energizing said low flow-rate discharging means in response to said ON signal and said high flow-rate water discharging means in response to said first OFF signal, said high flow-rate discharging means being energized for a second period of time longer than said first period of time, and said low flow-rate discharging means being deenergized a predetermined period after deenergization of said high flow-rate discharging means;

(3) third means responsive to said second OFF signal occurring during said second period of time for deenergizing said high flow-rate discharging means, thereby to interrupt the high flow in said bowl during use by said second user; and (4) fourth means responsive to said third OFF signal for reenergizing said high flow-rate water discharging means for said second period of time following departure of said second user.

2. The apparatus of claim 1, further including accumulator means for accumulating the total period of time that said high flow-rate discharging means is interrupted, said accumulator means causing said high flow-rate to be energized when said accumulated period of time exceeds a threshold level.

3. A toilet bowl flushing system, comprising:

(a) an electromagnetic valve means including means for discharging a low flow-rate of flushing water to said bowl and means for discharging a high flow-rate of flushing water to the bowl;

(b) means for detecting approach and departure of users of said bowl, said detecting means generating an ON signal indicative of said approach and initiation of use of said bowl by a first user, a first OFF signal indicative of said departure and termination of use of said bowl by said first user, a second OFF signal indicative of approach of a second user immediately after departure of said first user, and a third OFF signal indicative of departure of said second user; and (c) means for controlling operation of said valve means, including (1) first means responsive to said ON signal from said detecting means for energizing said high flow-rate water discharging means for a relatively short first period of time upon said initiation of use by said first user; and (2) second means for energizing said low flow-rate discharging means in response to said ON signal and said high flow-rate water discharging means in response to said first OFF signal, said high flow-rate discharging means being energized for a second period of time longer than said first period of time, and said low flow-rate discharging means being deenergized a predetermined period after deenergization of said high flow-rate discharging means.

* * * * *